US009185504B2

(12) United States Patent
Shennib et al.

(10) Patent No.: US 9,185,504 B2
(45) Date of Patent: Nov. 10, 2015

(54) DYNAMIC PRESSURE VENT FOR CANAL HEARING DEVICES

(71) Applicant: IHEAR MEDICAL, INC., San Leandro, CA (US)

(72) Inventors: Adnan Shennib, Oakland, CA (US); Victor Valenzuela, Hayward, CA (US); Patrick Contioso, Sunnyvale, CA (US); Greg Anderson, Fremont, CA (US)

(73) Assignee: IHEAR MEDICAL, INC., San Leandro, CA (US)

( * ) Notice: Subject to any disclaimer, the term of this patent is extended or adjusted under 35 U.S.C. 154(b) by 312 days.

(21) Appl. No.: 13/691,657

(22) Filed: Nov. 30, 2012

(65) Prior Publication Data

US 2014/0153761 A1 Jun. 5, 2014

(51) Int. Cl.
*H04R 25/00* (2006.01)

(52) U.S. Cl.
CPC ..... *H04R 25/652* (2013.01); *H04R 2460/11* (2013.01)

(58) Field of Classification Search
None
See application file for complete search history.

(56) References Cited

U.S. PATENT DOCUMENTS

| | | | | |
|---|---|---|---|---|
| 5,327,500 | A | 7/1994 | Campbell | |
| 5,553,152 | A | 9/1996 | Newton | |
| 5,645,074 | A | 7/1997 | Shennib et al. | |
| 5,659,621 | A | 8/1997 | Newton | |
| 5,701,348 | A | 12/1997 | Shennib et al. | |
| 5,785,661 | A | 7/1998 | Shennib et al. | |
| 6,000,492 | A * | 12/1999 | Puthuff et al. | 181/135 |
| 6,137,889 | A | 10/2000 | Shennib et al. | |
| 6,212,283 | B1 | 4/2001 | Fletcher et al. | |
| 6,359,993 | B2 | 3/2002 | Brimhall | |
| 6,367,578 | B1 | 4/2002 | Shoemaker | |
| 6,382,346 | B2 | 5/2002 | Brimhall et al. | |
| 6,473,513 | B1 | 10/2002 | Shennib et al. | |
| 6,546,108 | B1 | 4/2003 | Shennib et al. | |
| 6,724,902 | B1 | 4/2004 | Shennib et al. | |
| 6,937,735 | B2 | 8/2005 | DeRoo et al. | |
| 6,940,988 | B1 | 9/2005 | Shennib et al. | |
| 7,016,511 | B1 | 3/2006 | Shennib | |
| 7,113,611 | B2 | 9/2006 | Leedom et al. | |

(Continued)

FOREIGN PATENT DOCUMENTS

WO 99/07182 A2 2/1999

OTHER PUBLICATIONS

International Search Report and Written Opinion dated Nov. 3, 2010 for PCT Appl. No. US2010/048299.

(Continued)

*Primary Examiner* — Duc Nguyen
*Assistant Examiner* — Taunya McCarty
(74) *Attorney, Agent, or Firm* — Dorsey & Whitney LLP

(57) ABSTRACT

A seal assembly for canal hearing devices including a dynamic pressure vent formed and defined by diaphragmatic flaps configured to open in response to a pressure gradient across the diaphragm. The seal assembly comprises a compliant seal element configured to be positioned generally concentrically around the canal hearing device for providing comfortable contact with the ear canal and for acoustically sealing the residual volume of the ear canal. The seal assembly is preferably made of an elastomeric material. The dynamic pressure vent is substantially closed in the normal position to minimize feedback, while momentarily opening inside the ear canal during insertion or removal of the canal hearing device into or from the ear canal.

25 Claims, 5 Drawing Sheets

(56) References Cited

U.S. PATENT DOCUMENTS

| | | | |
|---|---|---|---|
| 7,215,789 | B2 | 5/2007 | Shennib et al. |
| 7,260,232 | B2 | 8/2007 | Shennib |
| 7,298,857 | B2 | 11/2007 | Shennib et al. |
| 7,310,426 | B2 | 12/2007 | Shennib et al. |
| 7,321,663 | B2 | 1/2008 | Olsen |
| 7,403,629 | B1 | 7/2008 | Aceti et al. |
| 7,424,123 | B2 | 9/2008 | Shennib et al. |
| 7,424,124 | B2 | 9/2008 | Shennib et al. |
| 7,580,537 | B2 | 8/2009 | Urso et al. |
| 7,664,282 | B2 | 2/2010 | Urso et al. |
| 8,155,361 | B2 | 4/2012 | Schindler |
| 8,184,842 | B2 | 5/2012 | Howard et al. |
| 8,467,556 | B2 | 6/2013 | Shennib et al. |
| 8,571,247 | B1 | 10/2013 | Oezer |
| 8,798,301 | B2 | 8/2014 | Shennib |
| 2001/0008560 | A1 | 7/2001 | Stonikas et al. |
| 2002/0027996 | A1 | 3/2002 | Leedom et al. |
| 2002/0085728 | A1 | 7/2002 | Shennib et al. |
| 2005/0249370 | A1 | 11/2005 | Shennib et al. |
| 2005/0259840 | A1 | 11/2005 | Gable et al. |
| 2005/0283263 | A1 | 12/2005 | Eaton et al. |
| 2006/0291683 | A1 | 12/2006 | Urso et al. |
| 2007/0071265 | A1* | 3/2007 | Leedom et al. ..... 381/322 |
| 2010/0040250 | A1 | 2/2010 | Gebert |
| 2010/0119094 | A1 | 5/2010 | Sjursen et al. |
| 2010/0239112 | A1 | 9/2010 | Howard et al. |
| 2011/0058697 | A1 | 3/2011 | Shennib et al. |
| 2011/0188689 | A1 | 8/2011 | Beck et al. |
| 2011/0206225 | A1 | 8/2011 | Møller et al. |
| 2012/0285470 | A9* | 11/2012 | Sather et al. ..... 128/207.18 |
| 2013/0010406 | A1 | 1/2013 | Stanley |
| 2013/0223666 | A1 | 8/2013 | Michel et al. |
| 2013/0243229 | A1 | 9/2013 | Shennib et al. |
| 2013/0294631 | A1 | 11/2013 | Shennib et al. |
| 2014/0150234 | A1 | 6/2014 | Shennib et al. |
| 2014/0153762 | A1 | 6/2014 | Shennib et al. |

OTHER PUBLICATIONS

"Lyric User Guide", http://www.phonak.com/content/dam/phonak/b2b/C_M_tools/Hearing_Instruments/Lyric/documents/02-gb/Userguide_Lyric_V8_GB_FINAL_WEB.pdf, Jul. 2010.

"User Manual—2011", AMP Personal Audio Amplifiers, 2011.

* cited by examiner

DYNAMIC PRESSURE VENT FOR CANAL HEARING DEVICES

TECHNICAL FIELD

Examples described herein relate to hearing devices, and include particularly hearing devices that are positioned in the ear canal for inconspicuous wear. This application is related to pending patent application Ser. No. 12/878,926, titled CANAL HEARING DEVICE WITH DISPOSABLE BATTERY MODULE, and Ser. No. 13/424,242, titled BATTERY MODULE FOR PERPENDICULAR DOCKING INTO A CANAL HEARING DEVICE, which are incorporated herein by reference in their entirety for any purpose.

BACKGROUND

The ear canal 10 (FIGS. 1 & 2) is generally narrow and tortuous and is approximately 26 millimeters (mm) long from the canal aperture 11 to the tympanic membrane 15 (eardrum). The lateral part is flexible and referred to as the cartilaginous canal 16 due to the underlying cartilaginous tissue beneath the skin 5. The medial part, proximal to the tympanic membrane, is rigid and referred to as the bony region 13 due to the underlying bone tissue. A characteristic first bend occurs roughly at the aperture 11 of the ear canal. A second characteristic bend 8 occurs roughly at the bony-cartilaginous junction and separates the cartilaginous region and the bony region. The dimensions and contours of the ear canal may vary significantly among individuals, but are generally narrow with little space for accommodating miniaturized components therewithin. The ear canal is generally sensitive to touch and pressure, particularly in the deeper region, which can readily experience discomfort, abrasion and trauma with pressure and rigid contact. Abrasion of the skin inside the ear canal due to hearing aid use is common and generally limits insertions to the lateral (outer) portions of the ear canal.

Placement of a hearing device inside the ear canal 10 (FIG. 1) is generally desirable for various electroacoustic advantages such as reduction of the acoustic occlusion effect, improved energy efficiency, reduced distortion, reduced receiver vibrations, and improved high frequency response. Placement inside the ear canal may also be desirable for cosmetic reasons, with many of the hearing impaired preferring to wear inconspicuous hearing devices. A canal hearing device can be inserted entirely or partially inside the ear canal. In the context of this application, a "canal hearing device" refers to any hearing device with sound delivery inside the ear canal, whether partially or fully inserted therein. This includes what is known in the hearing aid industry as Completely-In-the-Canal (CIC), In-The-Canal (ITC), invisible extended wear deep canal, as well as Receiver-In-the-Canal (RIC) devices.

SUMMARY

The present disclosure describes examples of dynamic pressure vents, seal assemblies and methods for safe acoustic sealing of canal hearing devices. A dynamic pressure vent for a canal hearing device according to some examples herein may include a flexible membrane having a thickness of 0.3 mm or less, and one or more flaps defined by one or more slits within the flexible membrane, wherein the one or more flaps are configured to temporarily deform and open in response to a pressure gradient across the flexible membrane while inside the ear canal. Diaphragmatic pressure valves incorporated within a flexible seal assembly of a canal hearing device are described, which may include three or more flexible flaps that are configured to be closed for acoustical sealing inside an ear canal during placement of the canal hearing device inside the ear canal, and wherein the flexible flaps are configured to temporarily deform and open upon pressure changes across the flaps.

A seal assembly for a canal hearing device according examples of the present disclosure may include a compliant sealing element and a membrane section in said compliant sealing element, the membrane section including one or more flaps formed therein, wherein at least one of the one or more flaps are configured to deform from a first position to a second position in response to a pressure gradient across the seal assembly while inside the ear canal. Canal hearing device assemblies according to this disclosure may include a canal hearing device and a seal assembly. The canal hearing device may include a microphone, a receiver, and a power source enclosed within a housing of the canal hearing device. The seal assembly may be removably attached to the canal hearing device and may include a compliant sealing element and a pressure vent configured to open responsive to a pressure gradient between a first side of the seal assembly and a second side of the seal assembly.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof constituting the best mode presently contemplated of practicing the invention, when taken in conjunction with the accompanying drawings, in which.

DETAILED DESCRIPTION

Figure 1:
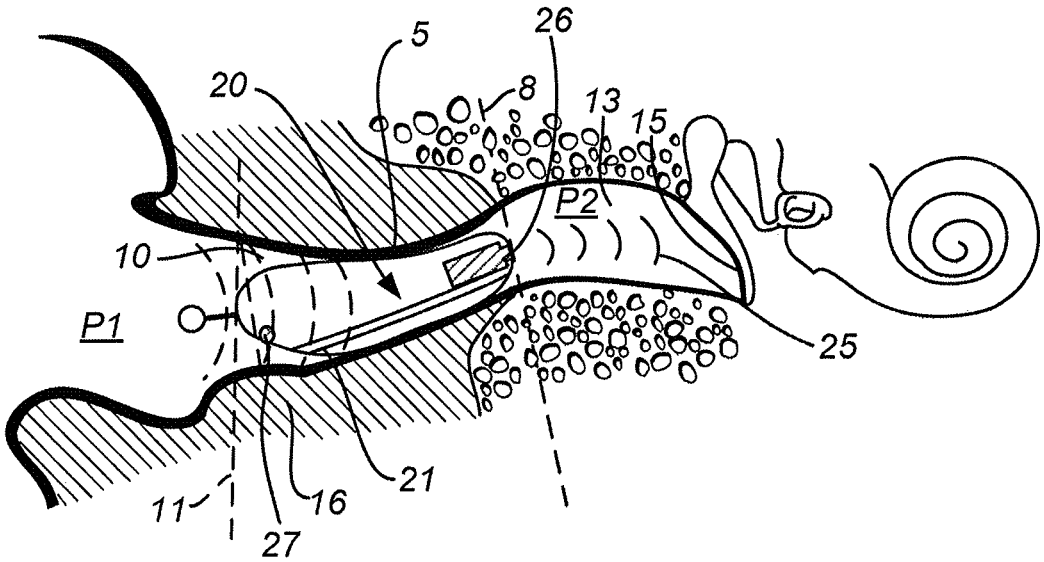
FIG. 1 is a cross-sectional view of the ear canal showing regions of the ear canal and conventional venting across a canal hearing device.

Certain details are set forth below to provide a sufficient understanding of embodiments of the invention. However, it will be appreciated by one skilled in the art that some embodiments may not include all details described. In some instances, well-known structures, hearing aid components, circuits, and controls, have not been shown in order to avoid unnecessarily obscuring the described embodiments of the invention.

Placement of an unvented hearing device inside the ear canal 10 may give rise to pressure buildup and moisture accumulation that may result in discomfort, infections, and/or trauma to the ear canal and the tympanic membrane (eardrum) 15. Venting may be used to allow air flow across the hearing device to provide acoustic occlusion relief, moisture release, and pressure equalization during insertion or removal of the canal device from the ear canal 10. Large venting is desirable on one hand to maximize these benefits (occlusion relief, moisture release, pressure release, etc.), but can also have adverse effects such as sound leakages and feedback. Venting in conventional hearing aid device is typically achieved by providing tubing 21 within the canal hearing device 20, or slits or grooves (not shown) across the housing of the canal hearing device 20.

Sealing may be used to prevent feedback, which may be caused by the leaking of a portion of amplified sound 25 from the receiver (speaker) port 26 into the microphone port 27, causing sustained oscillation. Sealing and venting are paradoxical. To minimize feedback, smaller vents are preferred. However, small vents do not allow sufficient air flow, particularly during rapid pressure changes in the ear canal such as during swift insertion or removal of the device from the ear canal, potentially causing pain and trauma to the tympanic membrane.

The present disclosure describes examples of methods and devices for acoustic sealing of canal hearing devices, for example as shown in FIGS. 2-8. An acoustic sealing device (also referred to herein as seal assembly) according to examples of the present disclosure includes a sealing element and a dynamic pressure vent (also referred to herein as pressure vent). The sealing element may be implemented from a compliant material and configured to fit conformally against walls of the ear canal. The dynamic pressure vent (also referred to herein as pressure valve), which may be incorporated within the seal element, is implemented as a diaphragm including one or more flaps, which are configured to open in response to a pressure gradient across the diaphragm.

Figure 3:
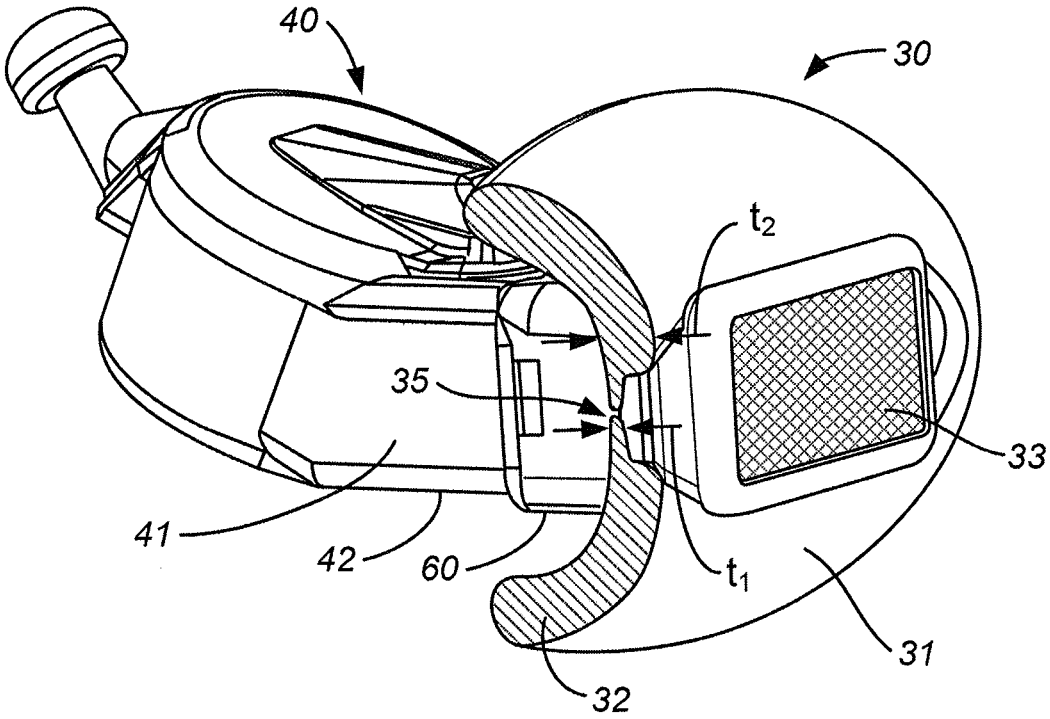
FIG. 3 is an isometric view of the canal hearing device of FIG. 2 with a partial cut-away showing the diaphragmatic pressure vent closed.
Figure 4:
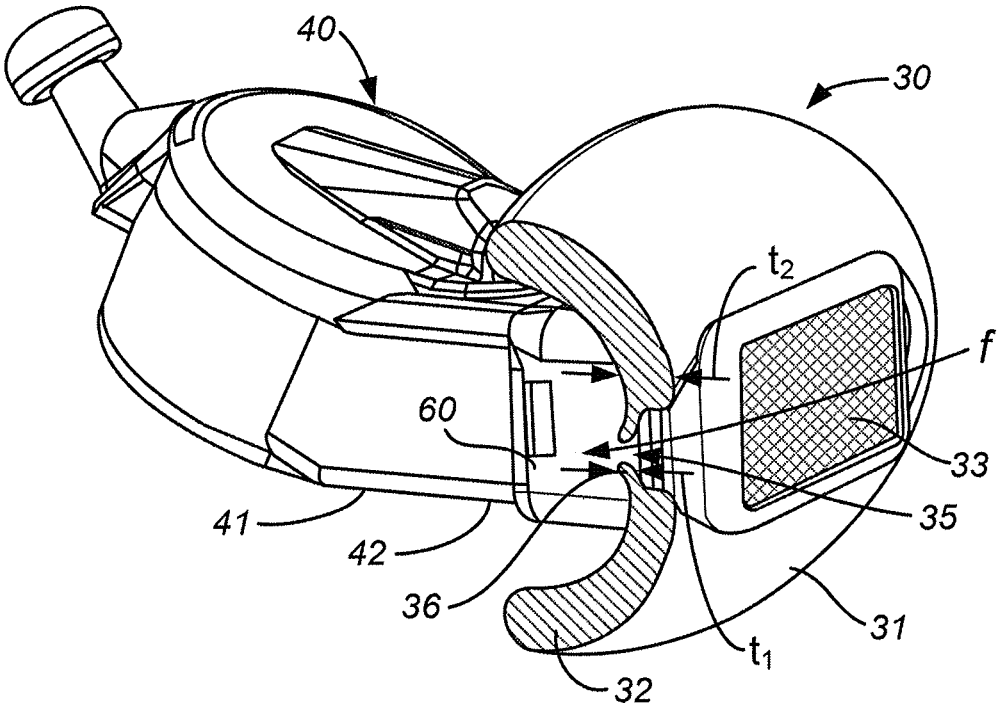
FIG. 4 is an isometric view of the canal hearing device of FIG. 2 with a partial cut-away showing the diaphragmatic pressure vent open, for example in response to insertion of the canal hearing device into the ear canal.
Figure 5:
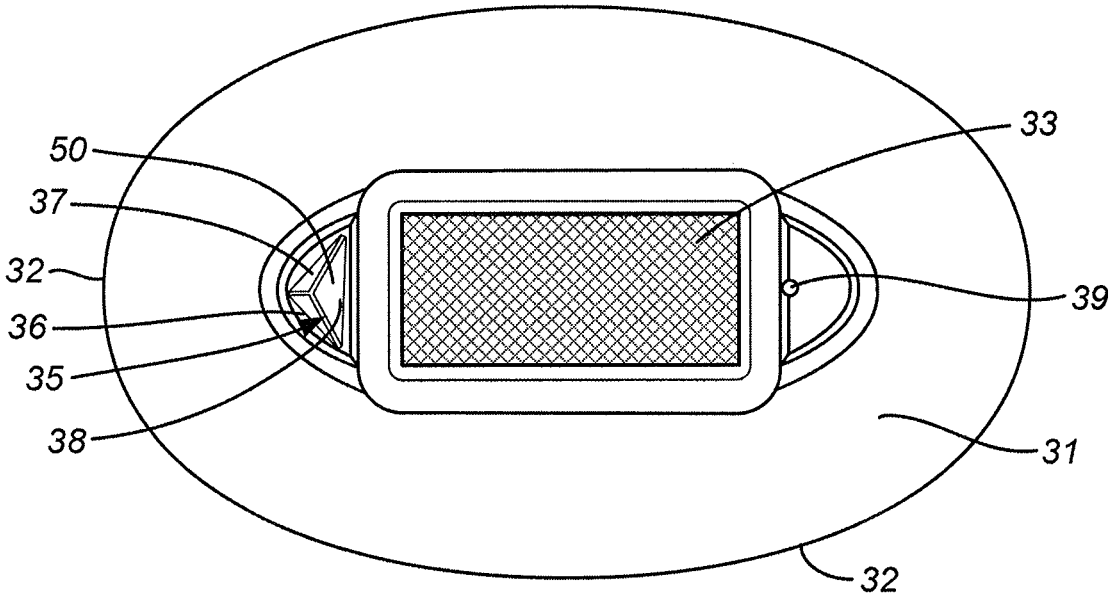
FIG. 5 is a view of the medial end of an example seal assembly showing a side air vent and diaphragmatic pressure vent positioned between the seal element and the speaker output region.
Figure 6:
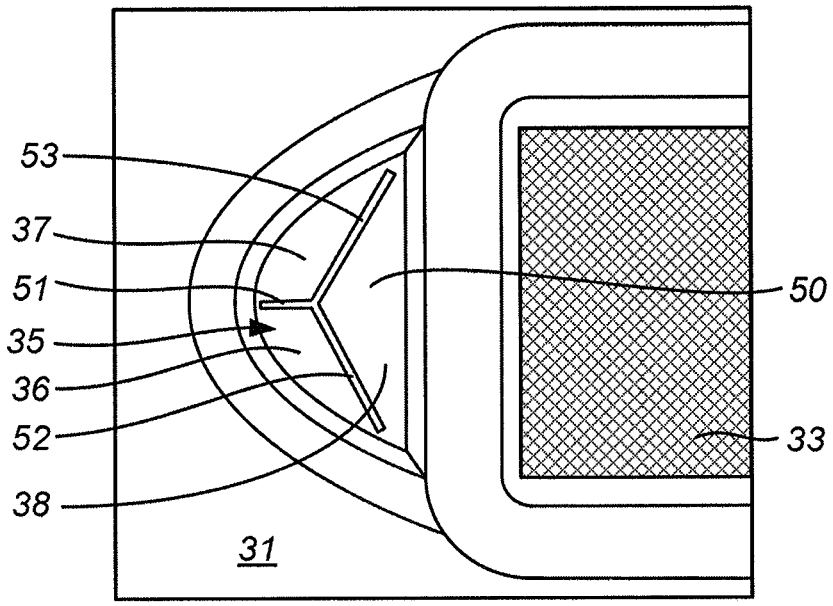
FIG. 6 is a detailed view of the diaphragmatic pressure vent comprising a 3 flap design in the closed state.
Figure 7:
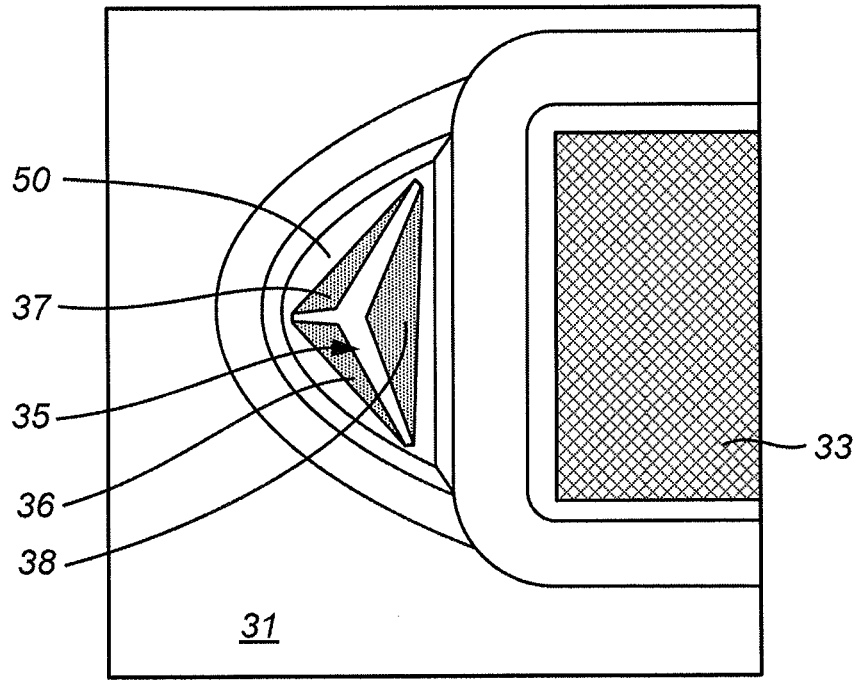
FIG. 7 is a detailed view of the diaphragmatic pressure vent of FIG. 6 shown in the open state in response to a pressure gradient.

An example of a seal assembly 30 according to the present disclosure is depicted in FIGS. 3-7. The seal assembly 30 may include a compliant sealing element 31, which may be adapted for a conforming fit with the walls 5 of the ear canal 10. The sealing element 31 is preferably made of a soft material, such as an elastomer, and is configured to acoustically seal the residual volume 28, defined as the cavity between the sealing element 31 and the tympanic membrane 15, when the hearing aid device is worn by a user. The seal assembly 30 further includes a diaphragm 50 having a pressure vent 35 formed therein, the pressure vent 35 defined by membrane flaps 36, 37 and 38 (FIGS. 5-7). The diaphragm 50 (interchangeably referred to herein as membrane, membrane element, or membrane section) may be integral with the sealing element 31 or it may be a separate component attached thereto. The diaphragm 50 is generally thinner than portions of the sealing element (e.g., as indicated by thicknesses t1 and t2, of the diaphragm and sealing element, respectively).

The membrane flaps (e.g. flaps 36, 37, and 38) are configured to open in response to an air pressure gradient (P2-P1) across the canal hearing device 40, for example a pressure gradient created when the canal hearing device is being placed inside the ear canal 10. In some examples, as shown in FIGS. 3 & 4, the seal assembly 30 is removably attached to the medial end of the housing 41 of the modular canal hearing device assembly 40, incorporating within a receiver, a microphone and a power source (not shown). In other examples (not shown), the seal assembly 30 may be attached to other portions of the canal hearing device 40. In yet other examples, the seal assembly may be fixedly attached to the canal hearing device 40 or to modular components (for example removable and/or disposable modules) of the canal hearing device 40. As will be understood, the seal assembly 30 may be attached to any portion of the canal hearing device 40 so as to provide effective acoustic sealing according to the particular configuration of the canal hearing aid device 40.

In one embodiment, the seal assembly 30 incorporating the diaphragm with pressure vent 35 may be positioned concentrically over the lateral end 42 of the canal hearing device 40 and may be configured to engage with it in a space efficient manner. The seal assembly 30 may provide acoustic attenuation across the canal hearing device, particularly within the audiometric frequency range between 1,000 to 4,000 Hz. The sealing element 31, as described herein, is made from a compliant material in order to fit a variety of ear canal sizes and shapes. In some examples, the sealing element 31 may be made of a biocompatible elastomeric material such as SILICONE, neoprene, or polyurethane foam.

Figure 2:
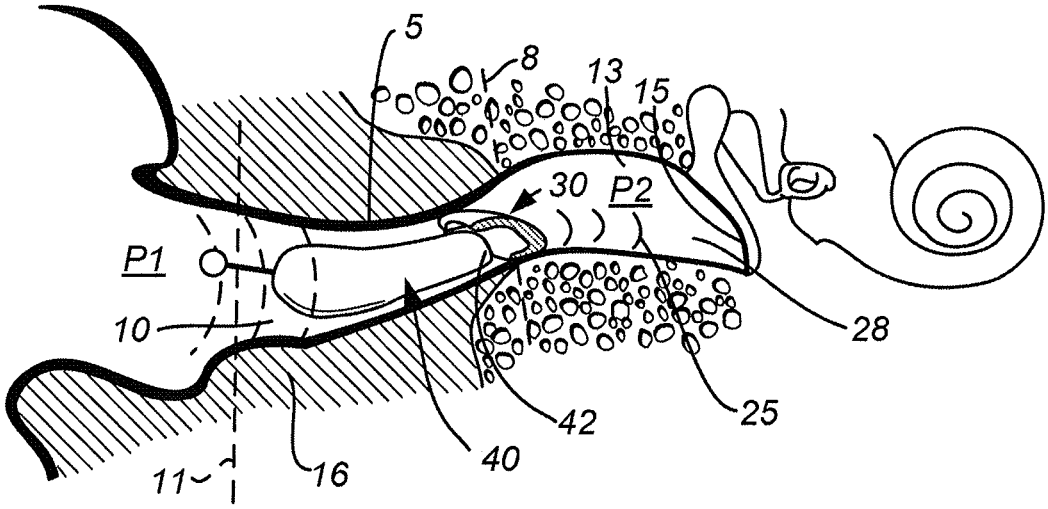
FIG. 2 is a cross-sectional view of a canal hearing device according to examples of the present disclosure positioned inside the ear canal, said canal hearing device including flanged seal approximately at the bony-cartilaginous region incorporating a diaphragmatic pressure vent.

In the preferred embodiments, the pressure vent 35 may be formed from the same material as used for the sealing element 31. In this regard, membrane section 50 may be made of an elastomeric material such as SILICONE, neoprene, polyurethane foam or the like. The diaphragm 50 and pressure vent 53 may be adapted to provide dynamic pressure venting in response to pressure changes inside the ear canal. Conventional pressure vents typically provide a conduit like the tubing 21 in FIG. 1 with fixed shape and dimensions that remain open regardless of pressure conditions inside the residual volume 28 or outside the ear canal, P2 and P1 respectively as shown in FIGS. 1 & 2. Conventional devices as in FIG. 1 with internal tubing 21 may have substantial propensity for feedback when pressure venting is made large to minimize occlusion and maximize air flow. Other conventional embodiments known in the art of hearing aid design (not shown) generally include one or more side slits or grooves on the outer surface the hearing device. While such methods offer compromises between venting and feedback control, they may still be deficient as they do not provide dynamic venting. In contrast, the pressure vent 35 as depicted in FIGS. 5-7 provides an essentially closed vent (see e.g., FIG. 3) for mitigating feedback in normal operation inside the ear canal, while dynamically and momentarily opening during insertion (see e.g., FIG. 4), removal, or generally during any air pressure gradient across the canal hearing device inside the ear canal.

Figure 8:
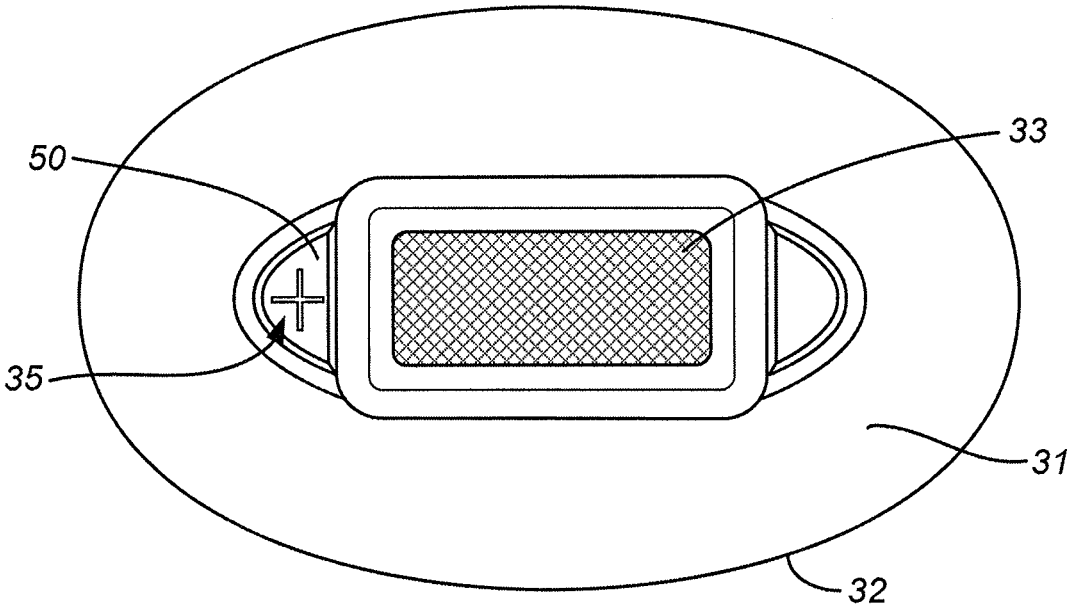
FIG. 8 shows an alternate embodiment of the diaphragmatic pressure vent comprising a 4 flap design.

In some embodiments, the pressure vent 35 incorporates flaps (e.g. membrane flaps 36, 37, and 38 as shown in FIGS. 5 and 6). The flaps may be formed by slits (51, 52 & 53 in FIG. 6) formed within the membrane section 50 of the sealing element 31. For example, the slits may be formed in a membrane section 50 positioned between sealing contact region 32 and receiver filter 33 covering the receiver port (see e.g., FIG. 6). In other examples, the pressure vent 35 may be positioned at another location along the surface sealing element 31. In the preferred embodiments, the pressure vent 35 and the sealing element 31 are integral parts of the seal assembly 30. Such integral design may be advantageous because it uses existing available space within the sealing element 31 thus consuming no additional space or parts. In the example depicted in FIGS. 5-7, the pressure vent includes three flaps. It will be understood that any number of flaps, for example a single flap, or a plurality of flaps may be used. In another example, as shown in FIG. 8, four flaps may be used, and the slits may be formed in a cross pattern. The slits and/or flaps may be symmetrically or asymmetrically arranged.

The flaps are generally configured to readily deform under certain pressure. For example, the flaps have a thickness and form factor selected to open in response to an air pressure gradient across the membrane section 50 (FIG. 7). The flaps are sufficiently resilient to return to a closed or nearly closed position (FIG. 6) after pressure equalization. The membrane flaps are sufficiently flexible to deform essentially instantly during pressure changes, for example during insertion or removal of the device from the ear canal. The flaps normally remain in a closed position (e.g., during normal operation of the canal hearing device 40) to provide acoustic sealing and prevent feedback inside the ear canal, while momentarily opening to allow air flow (f) and pressure equalization upon encountering an air pressure gradient (P2-P1) across the membrane 50, for example as may be due to insertion of the canal hearing device in the ear canal 10.

The dynamic venting mechanism according to example of the present invention may provide for safe operation of the hearing device while allowing greater levels of sealing and sound amplification due to the normally closed vent design. Canal hearing devices are particularly prone to feedback due to the miniaturization and proximity of the components, particularly between the speaker and the microphone. The seal assembly 30 with sealing element 31 made from flexible material such as SILICONE provides a conforming sealing when the dynamic pressure vent 35 is normally closed. The dynamic pressure vent may be designed for complete or nearly complete closure, in which slight and acoustically insignificant slits (across the audiometric frequency of interest) remain between the flaps, as shown in FIG. 6.

One or more fixed vents may be used in conjunction with the dynamic pressure vents as described herein. For example, a fixed vent 39 (FIG. 5) may be used to provide low level or low frequency venting during the closed state of the dynamic vent. A closed state of the dynamic pressure vent 35 is depicted in FIG. 6, with the flaps in a closed or nearly closed position, or virtually eliminating the aperture of the slits. The dynamic pressure vent 35 provide momentarily large venting in response to a pressure gradient as shown in FIG. 7, which depicts an open state of the pressure vent 35. The flaps may be configured to close and/or open in other magnitude or form than depicted in FIGS. 6 and 7, for example by selecting a different geometry and/or stiffness of one or more flaps. A dynamic design for the pressure vent 35, as described herein, largely mitigates compromises between pressure safety and acoustic performance. Furthermore, a dynamic pressure vent 35 according to the present disclosure may offer a self-regulating valve with a venting size varying according to the pressure condition in the ear canal. For example, rapid pulling of the canal hearing device 40 from the ear canal 10, may result in wider opening of the pressure vent 35 than during slow removal (e.g., where lower flow rate of air may be experienced).

In some embodiments, the dynamic pressure vent 35 is formed in a membrane segment 50 (e.g., diaphragm 50) within the non-contacting region of the seal element 31. The membrane segment 50 may be a thinned region of the seal element 31. The membrane segment 50 may have a thickness in the range of 0.15 mm to 0.3 mm. The sealing element at the contact region 32 is generally thicker, for example having a thickness in the range of about 0.5 mm to about 1 mm. The flaps 36, 37, & 38 are designed to remain in a closed position at equilibrium and low pressures generally under 0.5 PSI and provide air flow less than 15 sccm. The flaps 36, 37, & 38 are designed to deform and/or open in response to an atmospheric pressure gradient, for example a pressure gradient over 0.5 PSI. In some examples, the flaps may open responsive to a pressure gradient generally under 5 PSI which is considered a safe limit for the eardrum 15. The flaps 36, 37, and 38 may open substantially fully responsive to a pressure gradient in the range of 0.75 PSI to about 1.5 PSI to allow an air flow exceeding 200 sccm. The membrane segment 50 is preferably of the same material as the sealing element 31 to minimize real estate, parts, cost, and complexity of the design.

In an example embodiment as shown in FIGS. 5 & 6, the seal assembly 30 was made of SILICONE material. The thickness of the membrane region 50 in a functioning prototype was approximately 0.25 mm. The slits where asymmetrical with long slits 52 and 53 measured approximately 0.97 mm long and the short slit 51 was approximately 0.44 mm long. The diameter of the fixed side vent 39 was approximately 0.25 mm. The thickness of the sealing element 32 at the skin contact region 32 measured approximately 0.75 mm. The air flow (f) in the closed condition (as shown in FIG. 5) measured 18 sccm (standard cubic centimeter per minute) approximately at equilibrium pressure with the air flow being substantially dependent on the size of the side vent 39. The air flow initially increased to 59 sccm at pressure gradient of 0.5 PSI then reaching an air flow of over 200 sccm at 1.25 PSI. The side vent 39 may generally be less than 0.3 mm and may be eliminated entirely, as shown in FIG. 8, by adjusting the widths of slits 51, 52 and 53, which are preferably less than 0.15 mm, thus may be considered as an acoustic seal during normal operation of the canal hearing device 40 in the closed state. The air flow of the pressure vent 35 in the closed state may be limited to less than about 15 sccm. In some embodiments, the membrane slits may be formed by a punch tool or other conventional techniques for forming and/or molding polymeric materials.

In an example embodiment, shown in FIGS. 3 & 4, the seal assembly incorporates a clip element 60 formed of foil-thin rigid material, for securely attaching the seal assembly 30 to the lateral end 42 of a canal hearing device 40. In one embodiment, the clip element 60 is formed of metal foil and comprises means for space efficient engagement to the canal hearing device. For example, a means for engagement may include the clip element 60 and a corresponding feature, such as a slit or a pocket in the seal assembly 30 configured for cooperating fit with the clip element 60. The seal assembly 30 incorporating the diaphragmatic pressure vent 35 within may be designed to be replaced periodically, at a prescribed rate, or depending on individual use and conditions of ear canal. The user may generally be instructed to discard the seal assembly after becoming soiled or degraded.

Although examples of the invention have been described herein, it will be recognized by those skilled in the art to which the invention pertains from a consideration of the foregoing description of presently preferred and alternate embodiments and methods of fabrication and use thereof, and that variations and modifications of this exemplary embodiment and method may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A dynamic pressure vent of a compliant acoustical sealing element for a canal hearing device, the dynamic pressure vent comprising:

a flexible membrane provided along a medial surface of the compliant acoustical sealing element; and one or more flaps formed by one or more slits within the flexible membrane, wherein the one or more flaps are configured to temporarily deform and open in response to an air pressure gradient across the flexible membrane while inside an ear canal, wherein the one or more flaps are formed in a region between a sound port and a contact portion of the compliant acoustic sealing element.

2. The dynamic pressure vent of claim 1, wherein the one or more flaps comprise 3 flaps.

3. The dynamic pressure vent of claim 1, wherein the one or more flaps comprise 4 flaps.

4. The dynamic pressure vent of claim 1, wherein the membrane is made from an elastomeric material.

5. The dynamic pressure vent of claim 4, wherein the elastomeric material is SILICONE.

6. The dynamic pressure vent of claim 1, wherein the one or more flaps are configured to deform in response to a pressure gradient exceeding 0.5 psi.

7. The dynamic pressure vent of claim 1, wherein the one or more flaps are configured to deform in response to a pressure gradient within a range of 0.75 psi to 1.5 psi.

8. The dynamic pressure vent of claim 1, wherein the vent is configured such that air flow through the dynamic pressure vent when the dynamic pressure vent is open exceeds 200 sccm.

9. The dynamic pressure vent of claim 1, wherein the vent is configured such that air flow through the dynamic pressure vent when the dynamic pressure vent is closed is less than 15 sccm.

10. A diaphragmatic pressure valve incorporated within a medial surface of a flexible seal assembly of a canal hearing device, the diaphragmatic pressure valve comprising one or more flexible flaps that are configured to be closed for acoustical sealing inside an ear canal, and wherein the flexible flaps are configured to temporarily deform and open upon air pressure changes across the flaps, wherein the one or more flaps are formed in a region between a sound port and a contact portion of the flexible seal assembly.

11. A seal assembly for a canal hearing device, comprising:

a compliant acoustical sealing element; and a membrane section provided along a medial surface of the compliant acoustical sealing element, wherein the membrane section includes one or more flaps formed in the membrane section, wherein at least one of the one or more flaps are configured to deform from a first position to a second position in response to an air pressure gradient across the seal assembly while inside, wherein the one or more flaps are formed in a region between a sound port and a contact portion of the compliant acoustic sealing element an ear canal.

12. The seal assembly of claim 11, wherein the first position is a closed position and the second position is an open position.

13. The seal assembly of claim 11, wherein the membrane section has a thickness less than a thickness of a contact portion of the compliant sealing element.

14. The seal assembly of claim 11, wherein the one or more flaps includes three or more flaps.

15. The seal assembly of claim 11, further comprising an attachment portion for coupling the seal assembly to a canal hearing device.

16. The seal assembly of claim 15, wherein the attachment portion comprises a clip element configured to provide secure attachment to the canal hearing device.

17. The seal assembly of claim 16, wherein the seal assembly is configured for removable attachment to the canal hearing device.

18. The seal assembly of claim 11, further comprising a fixed vent.

19. A method for air pressure venting for a canal hearing device in-situ, the method comprising:

creating an air pressure gradient across a dynamic pressure vent provided on a medial surface of a compliant acoustical sealing element of the canal hearing device, by either insertion or removal of the canal hearing device into or out of an ear canal, wherein the dynamic pressure vent comprises one or more flexible flaps configured to be in a closed position during equal pressure across the flaps; and deforming the flaps to an open position responsive to the air pressure gradient, thereby allowing air flow and pressure equalization across the dynamic pressure vent, wherein the one or more flaps are formed in a region between a sound port and a contact portion of the compliant acoustic sealing element.

20. The method of claim 19, further comprising closing the dynamic pressure vent by allowing the flaps to return to the closed position following pressure equalization across the dynamic pressure vent.

21. A canal hearing device assembly comprising:

a canal hearing device including a microphone, a receiver, and a power source enclosed within a housing; and a seal assembly removably attached to the canal hearing device and including a compliant acoustical sealing element and an air pressure vent configured to open responsive to a pressure gradient between a first side of the seal assembly and a second side of the seal assembly, wherein the pressure vent is provided on a medial surface of the sealing element, and wherein the pressure vent is formed in a region between a sound port and a contact portion of the compliant acoustical sealing element.

22. The canal hearing device assembly of claim 21, wherein the canal hearing device assembly is modular.

23. The canal hearing device assembly of claim 21, wherein the pressure vent comprises three or more flexible flaps.

24. The dynamic pressure vent of claim 1, wherein the flexible membrane has a thickness of 0.3 mm or less.

25. The seal assembly of claim 11, wherein the membrane section has a thickness of 0.3 mm or less.

* * * * *